United States Patent [19]

Hugg

[11] Patent Number: 4,685,237

[45] Date of Patent: Aug. 11, 1987

[54] RETRACTABLE SWIVEL STUD

[76] Inventor: Clifford R. Hugg, 1621 S. Avenue H, Portales, N. Mex. 88130

[21] Appl. No.: 897,853

[22] Filed: Aug. 19, 1986

[51] Int. Cl.[4] ..... F41C 23/02; F16B 7/20

[52] U.S. Cl. ..... 42/85; 224/156; 24/590; 403/349

[58] Field of Search ..... 403/348, 349; 42/85, 42/75.02; 24/590, 596, 595; 224/156

[56] References Cited

U.S. PATENT DOCUMENTS

| | | | |
|---|---|---|---|
| 2,078,010 | 4/1937 | Meepos | 42/85 |
| 2,480,662 | 8/1949 | McKinzie | 42/85 |
| 2,642,689 | 6/1953 | Cline | 42/85 |
| 2,771,699 | 11/1956 | Herter | 42/85 |
| 3,061,965 | 11/1962 | Lewis | 42/85 |
| 3,226,872 | 1/1966 | Pachmayr | 42/85 |
| 4,209,157 | 6/1980 | Edmisten | 248/360 |
| 4,454,675 | 6/1984 | Ives | 42/85 |
| 4,505,012 | 3/1985 | Johnson | 24/643 |

*Primary Examiner*—Deborah L. Kyle
*Assistant Examiner*—Michael J. Carone

[57] ABSTRACT

The retractable swivel stud which extends to allow the attachment of a detachable gun sling swivel and strap to a firearm; and when force from the thumb or finger tip is exerted on the textured top surface of the spring-loaded stud, the stud retracts into the gunstock to a flush position and is retained there by means of symmetrically disposed slots, thus, leaving the stock free of protrusions, holes, or slots. The retracted position is retained by rotating the stud ninety-degrees in a clockwise direction, allowing the retaining device to enter detents in the sleeve's cylinder. The reversal of the foregoing procedure will extend the stud and retain it in the extended position. This movement is facilitated by the use of the spring which exerts pressure on the base of the stud at one end and the bottom of the hole in the stock at the other.

12 Claims, 11 Drawing Figures

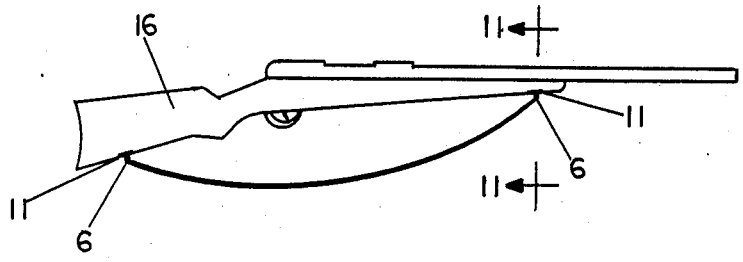
FIG. 1
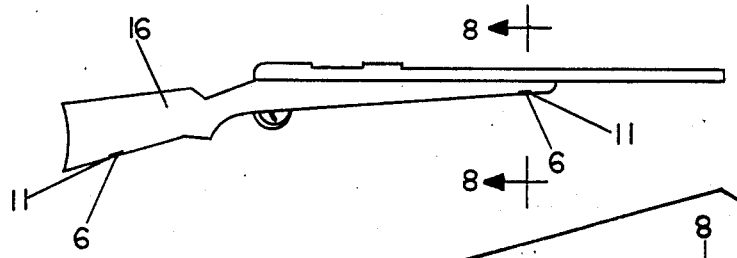
FIG. 2
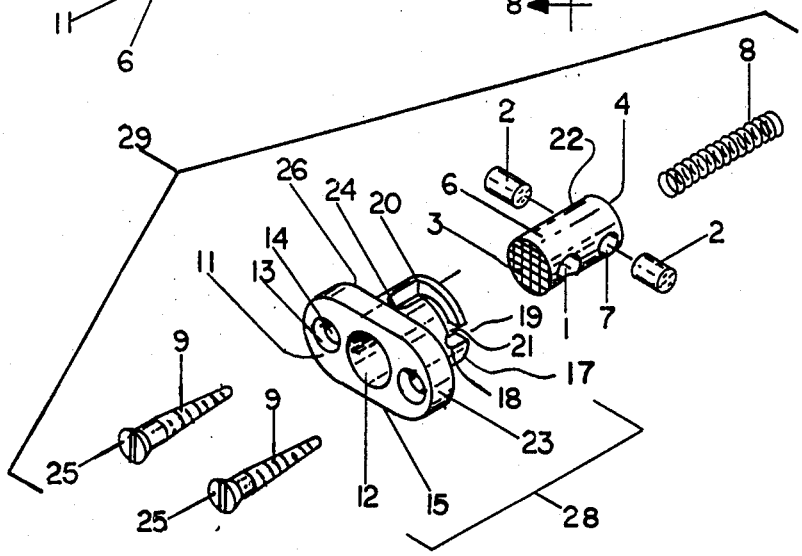
FIG. 3
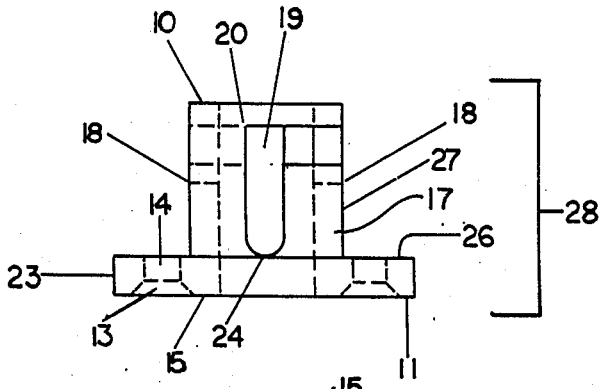
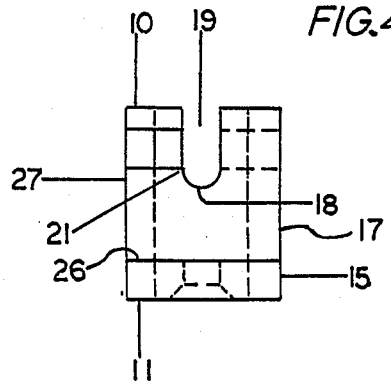
FIG. 4
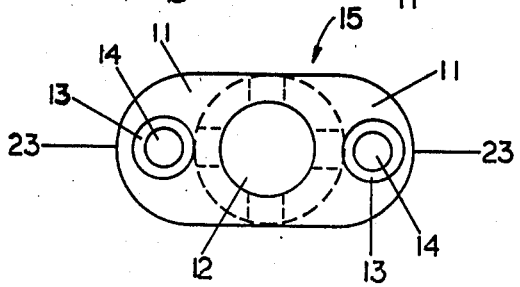

RETRACTABLE SWIVEL STUD

BACKGROUND OF THE INVENTION

This invention is a flush-mounted, spring-loaded, sling swivel stud designed to extend to allow the attachment of a carrying strap to a firearm or other device, and to retract when not in use.

The device used to attach sling swivels and slings to firearms (commonly known as a sling swivel stud) typically consists of an elongated plate which is secured by two screws at either end of a protruding eyelet. This plate is located on the underside of the firearm's buttstock and the eyelit serves as a securing device for one end of the carrying strap and swivel. The forward portion of the strap and the swivel is secured either with a similar stud which is housed in the forearm wood of this stock or in the form of a steel band around the circumference of the forearm and barrel or the barrel alone.

A later development consisted of a cylindrical stud which featured a dome-shaped top. This stud has a hole drilled completely through the cylindrical portion in order to accommodate the readily available, quick, detachable-type sling swivels. This is the most popular style of sling stud, due to the simplicity of installation and low cost. The rear or buttstock stud has a tapered woodscrew thread on the bottom end and may be attached by simply drilling a pilot hole in the buttstock and turning the stud into the wood while the screw tends to form threads in the softer wood. The forward stud is installed by drilling completely through the underside of the forearm of the stock and into the stock barrel channel. The channel end of this hole is counterdrilled in a larger diameter and approximately one-fourth inch deep in order to accept an escutcheon-type nut which is tapped or pressed into the large portion of the hole. The forward stud is threaded to mate with the escutcheon nut and the stud is turned into the stock forearm.

The aforementioned type of stud is serviceable and practical; however, it has obvious disadvantages. The buttstock stud may (due to the expansion and contractions of the wood as well as constant pressure of carrying the firearm) strip the self-formed threads of the softer wood. This creates a complicated and costly repair. When the sling is removed (for storing, showing the firearm, etc.), this type of stud remains visible and unsightly. This type of protruding stud causes snagging on various objects (clothes, upholstery, gun cases, saddle scabbards, etc.) by virtue of the design. Studs mounted on the rifle forearm that protrude from the stock can also cause bodily injury due to the painful blow received as the rifle recoils—particularly on rifles having heavy recoil.

All other sling swivel stud assemblies, which leave no protrusion on the gunstock when the sling and its swivels are removed, do not leave attractive, totally flush surfaces. They have holes which allow for the ingress of dirt and other foreign matter which can accumulate and interfere with their function.

The solution, then, is a flush-mounted, retractable swivel stud that will eliminate the aforementioned problems and as this one does, and even complements the appearance of the firearm.

SUMMARY OF THE INVENTION

The present invention provides for the attachment of a readily available, quick, detachable-type sling swivel to a gunstock. This is accomplished by means of a retractable swivel stud which acts as a secure mount for the swivel upon extension, and upon retraction, prevents snagging of the sling swivel stud during normal handling. In addition, the stud also prevents recoil injuries, exposes more area to be embellished with metal engraving and/or checkering, enhances the appearance of the firearm, and is resistant to the ingress of dirt and foreign substances.

This invention consists of seven basic components: the sleeve which is comprised of the flange and cylinder, the cylindrical stud, at least one retaining pin, a spring, and retaining screws. The flange is the only portion of the sleeve that is visible when the device is installed in the firearm stock. There are two slots located on each side of the cylindrical portion of the sleeve. These slots contain ninety-degree turns thus allowing for the stud to be retracted. A detent (in addition to the spring) is used to keep the stud in the retracted position.

The stud is housed inside the sleeve and is exposed in the center hole of the sleeve flange. Near its base the stud has two pins (which serve as a retaining device) protruding at ninety-degree angles from each side. These pins prevent the stud from being removed from the flange end of the sleeve. In the center of the stud's base or inner end, a hole is drilled for the insertion and retention of the coil spring. The spring makes contact with a base of the stud at one end, and the bottom of a hole in the gun stock at the other end. This spring provides constant resilient bias on the stud to facilitate extension as well as keeping the stud in its detent in the retracted position.

The retractable swivel stud is assembled by inserted the textured surface of the stud into the slotted base of the sleeve's cylinder. The coil spring is inserted into the hole at the base of the stud. This unit is inserted into a hole drilled in the stock. The flange portion is inletted into the stock to a depth where the top surface of the flange is flush with the stock's surface. Two woodscrews are countersunk into each shoulder of the oval flange. The sleeve's flange can be contoured to the profile shape of the stock.

As the stud is depressed at the flange end, the spring-loaded stud retracts to the flush position by means of the cylinder's slots. The retracted position is retained by rotating the stud ninety-degrees in a clockwise direction to a location where the retaining pins rest in detent. A reversal of the foregoing procedure extends the stud and retains it in the extended position. This allows for the attachment of a readily available, quick, detachable-type sling swivel which is affixed to the stud by the hole drilled in the exposed side of the stud.

A principal object of the present invention is the provision that (with the use of readily available, quick, detachable-type sling swivels) the carrying strap may be detached from the spring-loaded stud and the stud may be retracted into the flush-mounted stock sleeve and rotated into a locked position—rendering the stud incapable of snagging (clothes, upholstery, gun cases, saddle scabbards, etc.).

Another advantage of the present invention is that it provides a safety feature. Studs mounted on the firearm that protrude from the stock can cause bodily injury due to the painful blow received as the rifle recoils—particularly on rifles having heavy recoil. The present invention allows the user to retract the studs to avoid injury.

A further object of the present invention is that in the extended position, this stud device provides a very strong carrying strap attachment by virtue of its design. The sleeve distributes the pressure of the carrying strap over a greater area inside the stock. It also provides less chance of the stock cracking from excessive pressure during installation.

Another object of the invention is that in its retracted position, the flush-mounted retractable swivel stud provides relatively more area (which is readily accessible) to be embellished with metal engraving and/or checkering.

Yet another important advantage of the present invention is that it provides the viewer with an impression of the complete absence of sling swivel studs. This is a paramount consideration in attempting to influence show judges.

A still further object of the invention provides that upon removal of the sling and swivel assembly from the gunstock and the retraction of the stud, dirt and other foreign substances cannot enter the stud mechanism.

Other objects and advantages of this invention will become apparent herein as the detailed description which now follows is read in conjunction with the accompanying drawings.

BRIEF DESCRIPTION OF THE DRAWINGS

FIG. 1 is a flat view of a firearm embodying the invention in the firearm's gunstock. The invention is shown in its extended position and equipped with a sling and pair of swivels.

FIG. 2 is a flat view of a firearm, embodying the invention in the firearm's gunstock. The invention is in its retracted position.

FIG. 3 is an exploded view of the invention.

FIG. 4 is a detailed view of the sleeve of the invention.

DETAILED DESCRIPTION OF A PREFERRED EMBODIMENTS

Figure 5:
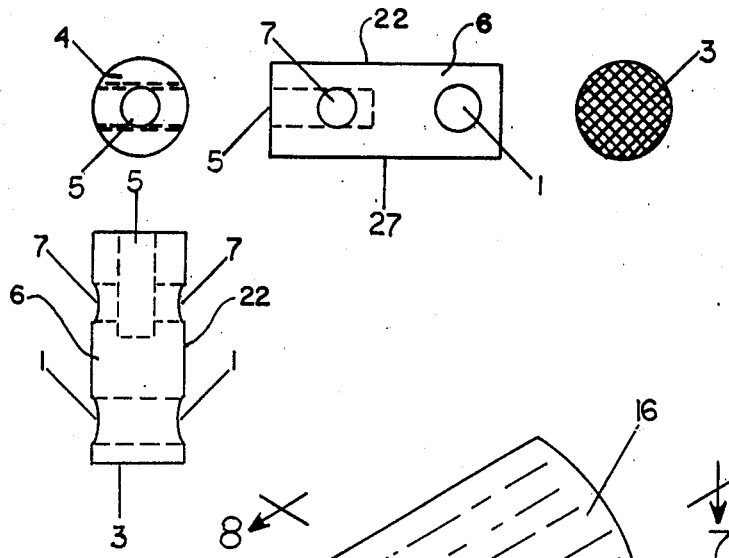
FIG. 5 is a detailed view of the stud of the invention.
Figure 6:
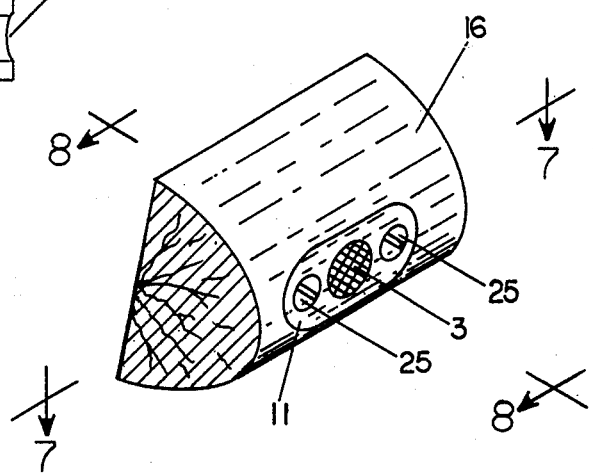
FIG. 6 is a pictorial view of a portion of a gunstock, showing the invention in its retracted position.
Figure 7:
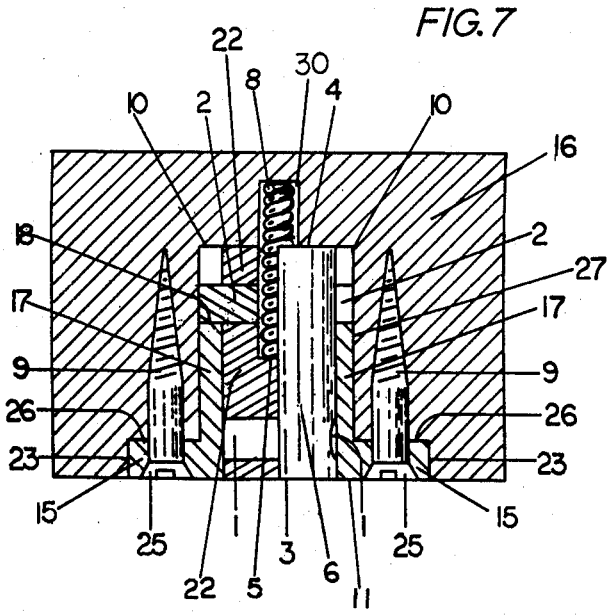
FIG. 7 is a sectional side view, taken along line 7—7, of the invention in its retracted position as shown in FIGS. 6 and 8.
Figure 8:
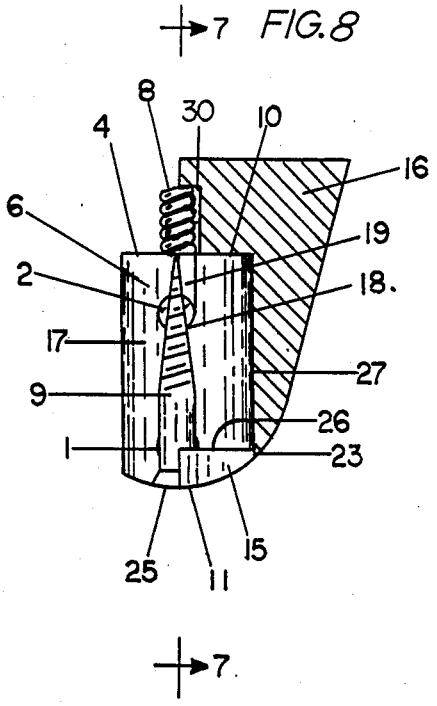
FIG. 8 is a sectional front view, taken along line 8—8, of the invention in its retracted position as shown in FIGS. 2 and 6.
Figure 9:
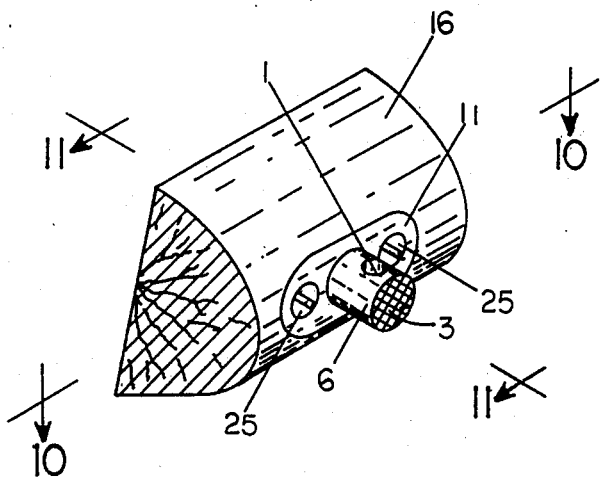
FIG. 9 is a pictorial view of a portion of a gunstock, showing the invention in its extended position.
Figure 10:
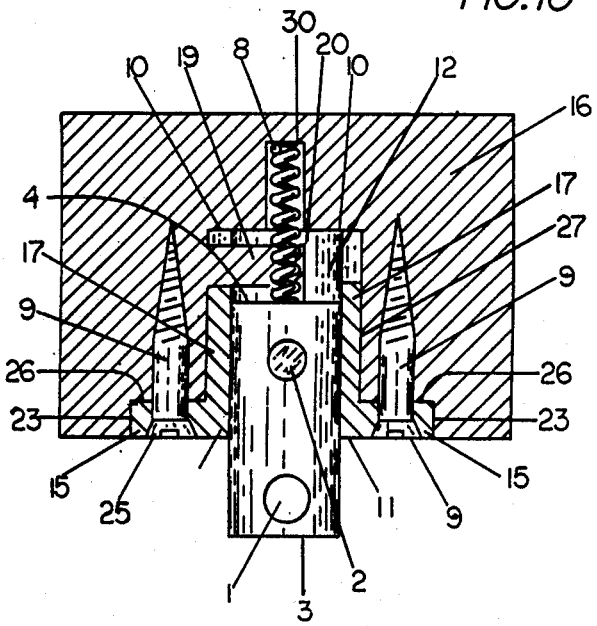
FIG. 10 is a sectional side view, taken along line 10—10, of the invention in its extended position as shown in FIGS. 9 and 11.
Figure 11:
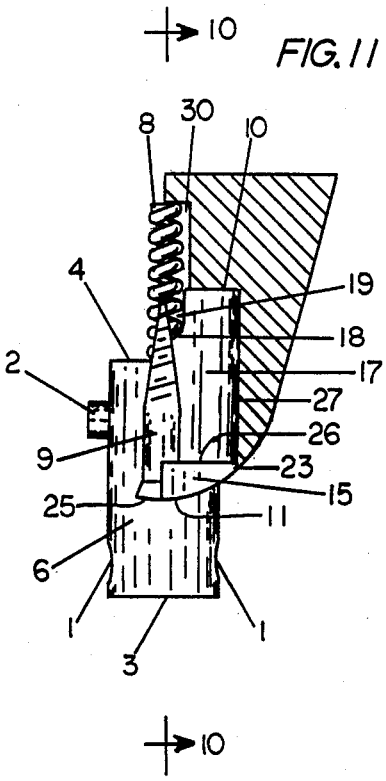
FIG. 11 is a sectional front view, taken along line 11—11, of the invention in its extended position as shown in FIGS. 1 and 9.

In describing a preferred embodiment of the invention illustrated in the drawings, specific terminology will be resorted to for sake of clarity. However, it is not intended to be limited to the specific terms so selected and it is to be understood that each specific term includes all technical equivalents which operate in a similar manner to accomplish a similar purpose.

Referring now to the drawings in FIGS. 1-11, wherein like numerals are used to designate similar parts throughout the several views. The numeral 16, as shown in FIG. 1, refers to a conventional gunstock having a detachable swivel and sling attached to identical retractable stud assemblies and constructed in accordance with my invention.

As shown in FIG. 2, a conventional gunstock (16) containing identical retractable swivel stud assemblies constructed in accordance with my invention are in their retracted position, thus, presenting a pleasing appearance and preventing the ingress of dirt and other foreign substances into the assembly.

In FIG. 3, as shown in the exploded view, the retractable swivel stud assembly (29) consists of seven basic components. The components are the sleeve (28) which is comprised of the flange (15) and the cylinder (17), the cylindrical stud (6), two retaining pins (2), the coil spring (8), and two retaining screws (9).

FIGS. 1-4 in the drawings show that, the flange (15) is oval-shaped to keep it and the cylinder (17) from rotating in the gunstock (16) when the firearm is being handled by the sling or strap. The sleeve is secured to the gunstock (16) by two woodscrews (9) that enter through the screw holes (14) in each shoulder (23) of the flange (15). The retractable cylindrical stud (6) moves snuggly through a bore (12) located and opening in the center of the flange (15) and equidistant from the axial center of the two woodscrew holes (14). This bore (12) extends from an opening in the surface (11) of the flange (15) through the cylinder (17) and exits at a second opening in the cylinder's base (10). The cylinder (17) and flange (15) are set into a mortise and retaining hole machined into the gunstock (16) to such a depth as to cause the exposed surface (11) of the flange (15) to be level with the surface of the gunstock (16).

As shown in FIGS. 3 and 4, the cylinder (17) has symmetrically disposed slots (19) extending from the base (26) of the flange (15) to the base (10) of the cylinder (17). These slots (19) are milled to allow the stud (6) access to the sleeve and act on the stud (6) in such a way as to allow the stud (6) to be extended and retracted at will. The slots (19) each have two ninety-degree corners (20,21) which require the stud to have to be rotated for operation of this invention. The corners (21) near the slotted base (10) have detents (18).

Referring to FIGS. 3-5, the stud's wall (22) has two sets of through holes (1,7). The through hole (1) which is drilled near the textured surface (3) of the stud (6) is for attaching a sling swivel when the stud (6) is extended. Pins (2) are placed in the through holes (7) near the base (4) of the stud (6) and silver-brazed in place so as to extend radially outwardly from the stud (6). The pins (2) do not extend past the outer wall (27) of the cylinder (17) nor into the guide hole (5) in the base (4) of the stud (6). A coil spring (8) holds the stud (6) against the closed end (24) of the sleeve's slots (19) upon extension outwardly and against the detents (18) upon retraction inwardly. The spring (8) is held snuggly in place by the guide hole (5) located in the center of the base (4) of the stud (6) and aligned with the retaining hole in the gunstock (16).

Considering FIG. 3 along with FIGS. 4 and 5, the retractable swivel stud is assembled by inserted the textured outer end surface (3) of the stud (6) into the slotted base (10) of the cylinder (17). The pins (2) and stud (6) travel through the slots (19) until the stud (6) has completely entered the sleeve (28). The spring (8) is inserted into the guide hole (5) in the base (4) of the stud (6). This unit is inserted into the mortise and retaining hole machined in the gunstock (16). The flange (15) and woodscrews (9) can be contoured to the profile shape of the gunstock (16) after the two woodscrews (9) are countersunk into each shoulder (23) of the flange (15).

FIGS. 4, 6–8, illustrate the invention in its retracted position. To retract the stud (6), into the gunstock the user pushes the stud into the cylinder (17) by placing a thumb or finger tip on the textured end surface (3) of the stud (6) and applies enough force to overcome the spring (8). The stud (6) is pushed into the cylinder (17) until it is stopped by the two pins (2) bearing on the ninety-degree corners (20) of the symmetrically disposed slots (19). At this point, the user's finger rotates the stud clockwise ninety-degrees to cause the pins (2) on the stud (6) to move to the next ninety-degree corners (21). The stud (6) is stopped by the corners (21). As the user releases pressure on the stud (6), the spring (8), which is being retained by the guide hole (5) and the retaining hole (30), forces the pins (2) on the stud (6) into the detents (18), thereby, holding the stud (6) in a retracted position until it is to be extended. This retracted position renders the stud (6) incapable of snagging and causing bodily injury to the user.

FIGS. 4, 9–11, illustrate the invention in its extended position. To extend the stud (6) outwardly relative to the stock, the user places a thumb or finger tip on the textured surface (3) of the stud (6) with enough force to overcome the spring (8). This retracts the pins (2) from the detents (18). The user rotates his thumb or finger tip ninety-degrees counterclockwise until the stud (6) is stopped by the pins' (2) contact with the ninety-degree corners (20). Pressure is released and the spring (8) pushes the stud (6) and pins (2) out of the corners (20) of the cylinder (17) until the pins (2) contact the closed ends (24) of the slots (19). The spring (8) holds the stud (6) in place in its outwardly extended status while the sling is attached and used.

Considering FIGS. 1–11, torque is transferred from the sling to the pins (2) through the stud (6) and to the base (26) of the flange (15). From the flange (15), pressure is transferred to the gunstock (16) by means of the heads (25) of the screws (9) holding against the counterbores (13) in the shoulders (23) of the flange (15), thus, creating a strong carrying strap attachment by distributing the pressure over a greater area inside the gunstock (16).

It will be recognized that the foregoing is but one example of an apparatus and method within the scope of the invention and that various other modifications will occur to those skilled in the art upon reading the disclosure set forth hereinbefore.

The invention claimed is:

1. A retractable stud assembly for affixing a detachable-type swivel to a structure, and including means for restraining said stud assembly in a flush mounted position within said structure, said stud assembly comprising:

a cylinder having a flanged portion and a central passageway extending therethrough adapted to movably retain a stud;

a stud movably received in said passageway and including an outer end and an inner end, said outer end of said stud extending beyond said flanged portion when in an extended position, and flush with said flanged portion when retracted to said flush mounted position;

means carried on said stud adjacent said outer end for detachably affixing a detachable-type swivel to said stud when said stud is in its extended position;

means on said cylinder for locking said stud in said flush mounted position; and a spring means contacting said stud and resiliently biasing said outward end of said stud outwardly from said bore beyond said flange, and resiliently opposing inward retraction of said stud in said passageway toward said flush mounted position.

2. The retractable stud assembly defined in claim 1 wherein said flanged portion includes shoulders projecting on opposite sides of an outer end of said cylinder, said shoulders defining a pair of spaced fastener having openings therethrough, whereby said stud assembly can be fastened to said structure.

3. The retractable stud assembly defined in claim 1 wherein said stud assembly further includes at least one pin secured to, and projecting radially outwardly from, said stud between the inner and outer ends thereof for cooperating with said locking means on said cylinder.

4. The retractable swivel stud assembly defined in claim 3 wherein said locking means on said cylinder for locking said stud in a retracted position comprises symetrically disposed slots formed in the side of said cylinder and communicating with the passageway through said cylinder, and positioned for receiving said pin therein.

5. The retractable stud assembly of claim 4, and further characterized in having detents projecting radially with respect to said cylinder symetrically disposed on slots to receive said pin and retain said stud in a retracted position.

6. The retractable stud assembly as defined in claim 1 wherein said stud is characterized in having a textured surface on said outer end.

7. The retractable stud assembly of claim 1 wherein said means for affixing a detachable-type swivel to said stud comprises a hole formed through said stud adjacent said outer end thereof.

8. The retractable stud assembly as defined in claim 1 wherein said stud defines a guide hole extending into said inner end thereof and receiving a portion of said spring.

9. The retractable stud assembly defined in claim 8 wherein said means for affixing a detachable-type swivel to said stud comprises a hole formed through said stud adjacent said outer end thereof.

10. The retractable stud assembly defined in claim 9 wherein said assembly further includes at least one pin secured to, and projecting radially outwardly from, said stud for cooperating with said locking means on said cylinder.

11. The retractable stud assembly defined in claim 10 wherein said locking means on said cylinder for locking said stud in a retracted position comprises symetrically disposed slots formed in the side of said cylinder and communicating with the passageway through said cylinder, and positioned for receiving said pin therein.

12. A gun comprising:

a gun stock having a hole extending thereinto;

a detachable swivel;

a carrying sling connected to said detachable swivel; and a retractable stud assembly connecting said detachable swivel to the gun stock, said retractable stud assembly mounted in said hole formed in the gunstock, and including:

a spring having a first end bearing against the bottom of said hole in the gun stock, and having a second end opposite said first end;

an elongated, generally cylindrical stud having a first end and a second end, and having a guide hole formed coaxially into said first end of said stud, and receiving therein said second end of said spring;

means carried on the second end of said stud for detachably connecting said swivel thereto;

at least one pin projecting radially outwardly from the side of said cylindrical stud between the first and second ends thereof;

a flanged sleeve defining a bore therethrough slidingly receiving said stud therein for reciprocating motion of said stud in said flanged sleeve, said flanged sleeve comprising:

(a) a flange extending normal to a longitudinal axis of said elongated stud sleeve, said flange having an opening therethrough; and (b) a tubular element having a first end secured to said flange, and having a second end open for receiving said stud, said tubular element having a bore therethrough extending into said tubular element from said open second end and communicating with said opening in said flange at the first end of said tubular element, said bore receiving said stud, said tubular element further having a slot formed in the wall thereof and communicating, through the wall, with said bore, said slot receiving said pin projecting radially from said stud for guiding the movement of said pin when said elongated stud is rotated about its longitudinal axis, said slot being configured for retaining said stud in a retracted locked position when said stud is turned about its longitudinal axis to position said pin at a first location in said slot, and permitting said stud to be extended by said spring to an extended, swivel engaging position when said stud is rotated about its longitudinal axis to move said pin to a second location in said slot; and means securing said flange to said gun stock to retain said tubular element in the hole in said stock.

* * * * *